US009062568B2

(12) United States Patent
Sadhu et al.

(10) Patent No.: US 9,062,568 B2
(45) Date of Patent: Jun. 23, 2015

(54) ASYMMETRIC BUTTERFLY PLATE FOR STEAM TURBINE EXHAUST HOOD

(75) Inventors: Antanu Sadhu, Karnataka (IN); Prakash Bavanjibhai Dalsania, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 809 days.

(21) Appl. No.: 13/273,387

(22) Filed: Oct. 14, 2011

(65) Prior Publication Data

US 2013/0094956 A1 Apr. 18, 2013

(51) Int. Cl.
*F01D 25/24* (2006.01)
*F01K 7/30* (2006.01)

(52) U.S. Cl.
CPC ..... *F01D 25/24* (2013.01); *F05D 2220/31* (2013.01); *F01K 7/30* (2013.01)

(58) Field of Classification Search
CPC ..... F01D 25/24; F05D 2220/31; F01K 7/30
USPC ..... 415/119, 914, 108, 208.1, 211.1, 226
See application file for complete search history.

(56) References Cited

U.S. PATENT DOCUMENTS

| | | | | |
|---|---|---|---|---|
| 1,938,800 | A * | 12/1933 | Bourne | 454/206 |
| 2,991,927 | A * | 7/1961 | Quick | 415/211.2 |
| 3,149,470 | A * | 9/1964 | Herzog | 60/697 |
| 3,735,782 | A * | 5/1973 | Strscheletzky | 138/39 |
| 4,013,378 | A | 3/1977 | Herzog | |
| 4,214,452 | A | 7/1980 | Riollet et al. | |
| 4,326,832 | A * | 4/1982 | Ikeda et al. | 415/213.1 |
| 4,390,319 | A | 6/1983 | Garkusha et al. | |
| 5,203,674 | A * | 4/1993 | Vinciguerra | 415/211.2 |
| 5,257,906 | A | 11/1993 | Gray et al. | |
| 5,340,276 | A * | 8/1994 | Norris et al. | 415/208.1 |
| 5,518,366 | A * | 5/1996 | Gray | 415/226 |
| 6,419,448 | B1 | 7/2002 | Owczarek | |
| 6,629,819 | B1 * | 10/2003 | Brown et al. | 415/208.1 |
| 6,953,104 | B2 * | 10/2005 | Monson et al. | 181/224 |
| 6,971,842 | B2 | 12/2005 | Luniewski et al. | |
| 7,600,962 | B2 | 10/2009 | Mizumi et al. | |
| 7,780,403 | B2 | 8/2010 | Fridsma | |
| 8,317,467 | B2 | 11/2012 | Dalsania et al. | |
| 2007/0081892 | A1 * | 4/2007 | Sharrow | 415/211.2 |
| 2009/0123277 | A1 * | 5/2009 | Dalsania et al. | 415/211.2 |
| 2009/0263241 | A1 * | 10/2009 | Demiraydin et al. | 415/207 |
| 2010/0162705 | A1 | 7/2010 | Sharrow et al. | |
| 2010/0247304 | A1 * | 9/2010 | Merchant et al. | 415/207 |
| 2010/0251716 | A1 * | 10/2010 | Boss et al. | 60/690 |
| 2013/0047612 | A1 * | 2/2013 | Sadhu et al. | 60/643 |

FOREIGN PATENT DOCUMENTS

| | | |
|---|---|---|
| EP | 1707762 A2 | 10/2006 |

* cited by examiner

*Primary Examiner* — Nathaniel Wiehe
*Assistant Examiner* — Wayne A Lambert
(74) *Attorney, Agent, or Firm* — Cantor Colburn LLP

(57) ABSTRACT

An asymmetric butterfly plate for a steam turbine exhaust hood includes a non-symmetrical curvilinear profile having a first section that extends to a second section through a vertex. The first section has a first curvilinear profile and the second section has a second curvilinear profile that is distinct from the first curvilinear profile.

15 Claims, 3 Drawing Sheets

ASYMMETRIC BUTTERFLY PLATE FOR STEAM TURBINE EXHAUST HOOD

BACKGROUND OF THE INVENTION

The subject matter disclosed herein relates to the art of steam turbomachines and, more particularly, to an asymmetric butterfly plate for a steam turbomachine exhaust hood.

Many power generation facilities employ steam turbomachine systems having a low pressure (LP) steam turbine portion coupled to an intermediate pressure (IP) steam turbine portion and a high pressure (HP) steam turbine portion to drive a generator. In general, steam is expanded in the LP steam turbine portion and channeled into an exhaust hood. The exhaust hood separates steam from atmospheric conditions, while providing support to rotating and stationary turbomachinery. Generally, stationary components direct steam toward rotating components to facilitate rotor rotation that is employed in power generation.

An exemplary exhaust hood is formed from various complex sheet metal plates that are combined to form a shell assembly. The shell assembly is formed to include various connections for internal and external components. The shell assembly includes upper and lower halves that guide steam downward toward a condenser. The exhaust hood includes a butterfly plate that turns an upper steam flow 180° downward toward the condenser. Existing butterfly plates include both linear and elliptical cross-sectional profiles that turn the upper steam flow vertically downward.

BRIEF DESCRIPTION OF THE INVENTION

According to one aspect of the exemplary embodiment, an asymmetric butterfly plate for a steam turbine exhaust hood includes a non-symmetrical curvilinear profile having a first section that extends to a second section through a vertex. The first section has a first curvilinear profile and the second section has a second curvilinear profile that is distinct from the first curvilinear profile.

According to another aspect of the exemplary embodiment, a steam turbine exhaust hood includes an exhaust hood section, and an asymmetric butterfly plate arranged in the exhaust hood section. The asymmetric butterfly plate includes a non-symmetrical curvilinear profile having a first section that extends to a second section through a vertex. The first section has a first curvilinear profile and the second section has a second curvilinear profile that is distinct from the first curvilinear profile.

According to yet another aspect of the exemplary embodiment, a steam turbomachine system includes a turbine portion having an inlet section and an exhaust section, and an exhaust hood mounted to the exhaust section. The exhaust hood includes an exhaust hood section, and an asymmetric butterfly plate arranged in the exhaust hood section. The asymmetric butterfly plate includes a non-symmetrical curvilinear profile having a first section that extends to a second section through a vertex. The first section has a first curvilinear profile and the second section has a second curvilinear profile that is distinct from the first curvilinear profile.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
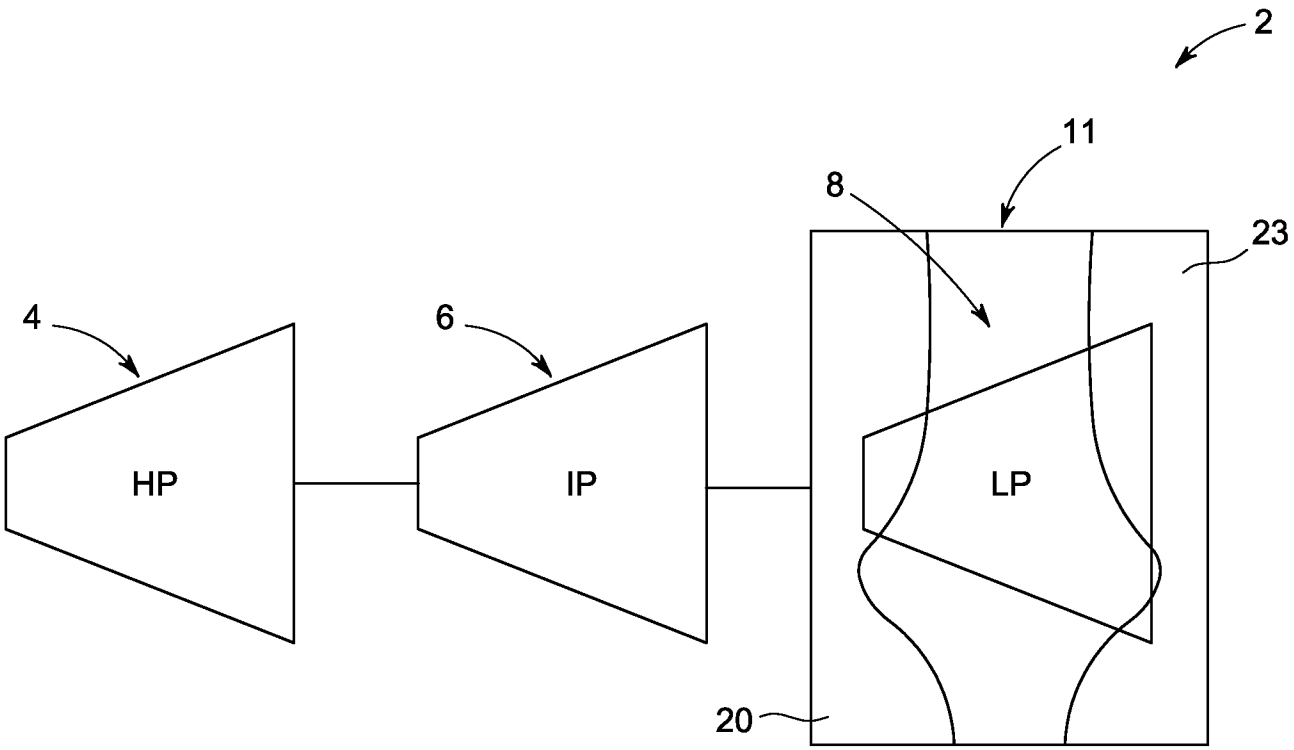
FIG. 1 is a schematic representation of a steam turbomachine system including a low pressure (LP) steam turbine portion having an exhaust hood provided with a butterfly plate formed in accordance with an exemplary embodiment.

Referencing FIG. 1, a steam turbomachine system in accordance with an exemplary embodiment is indicated generally at 2. Steam turbomachine system 2 includes a high pressure (HP) steam turbine portion 4 operatively coupled to an intermediate pressure (IP) steam turbine portion 6 which, in turn, is operatively coupled to a low pressure (LP) steam turbine portion 8. In the exemplary embodiment shown, LP steam turbine portion 8 includes an exhaust hood 11. Exhaust hood 11 is shown as a non-symmetric down exhaust hood. However, it should be understood that exhaust hood 11 could also take the form of a symmetric down exhaust hood as well as a side exhaust hood both symmetric and non-symmetric.

Figure 2:
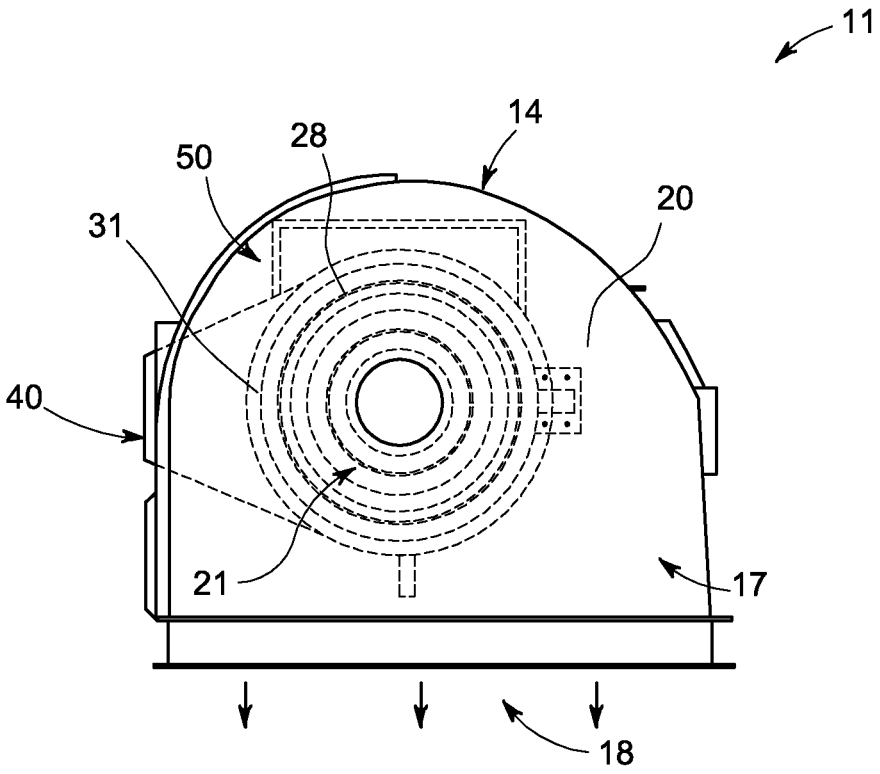
FIG. 2 is an elevational view of the LP steam turbine portion and exhaust hood in accordance with an exemplary embodiment.
Figure 3:
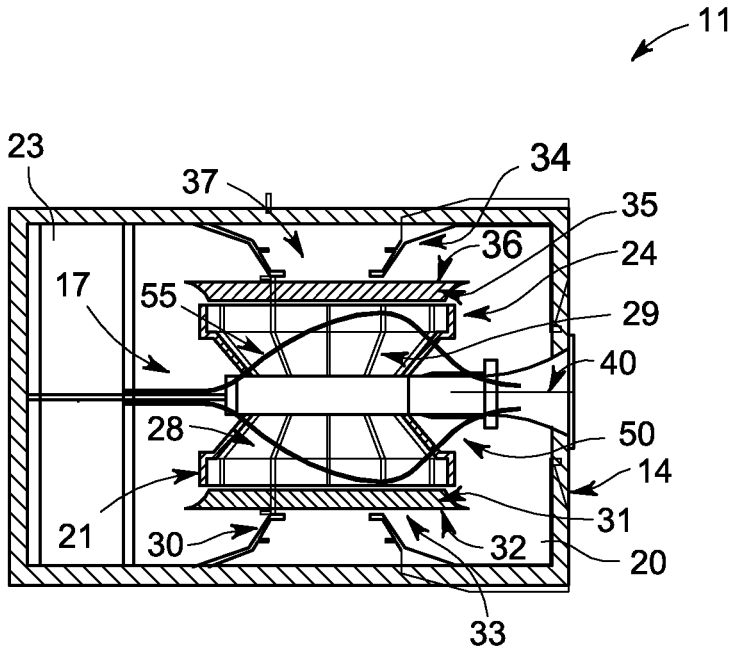
FIG. 3 is an upper plan view of the LP steam turbine portion and exhaust hood in accordance with an exemplary embodiment.

As best shown in FIGS. 2-3, exhaust hood 11 includes a main body 14 that defines an interior housing 17 having a lower opening 18. Main body 14 is divided into a first exhaust hood section 20 that houses a first LP steam turbine section 21 and a second exhaust hood section 23 that houses a second LP steam turbine section 24. First LP steam turbine section 21 includes a first inner casing 28 that is supported within first exhaust hood section 20. Similarly, second LP steam turbine section 24 includes a second inner casing 29 supported within second exhaust hood section 23. First inner casing 28 includes a first bearing cone 30, a first steam guide 31 having an outlet section 32, and a connector member 33 that is configured and disposed to connect with LP steam turbine portion 8. Likewise, second inner casing 29 includes a second bearing cone 34, a second steam guide 35 having a second outlet section 36, and a second connector member 37 also configured to connect with LP steam turbine portion 8. Exhaust hood 11 also includes a LP turbine inlet 40 that is fluidly connects IP turbine portion 6 with LP turbine portion 8 via first and second LP turbine sections 21 and 24.

Figure 4:
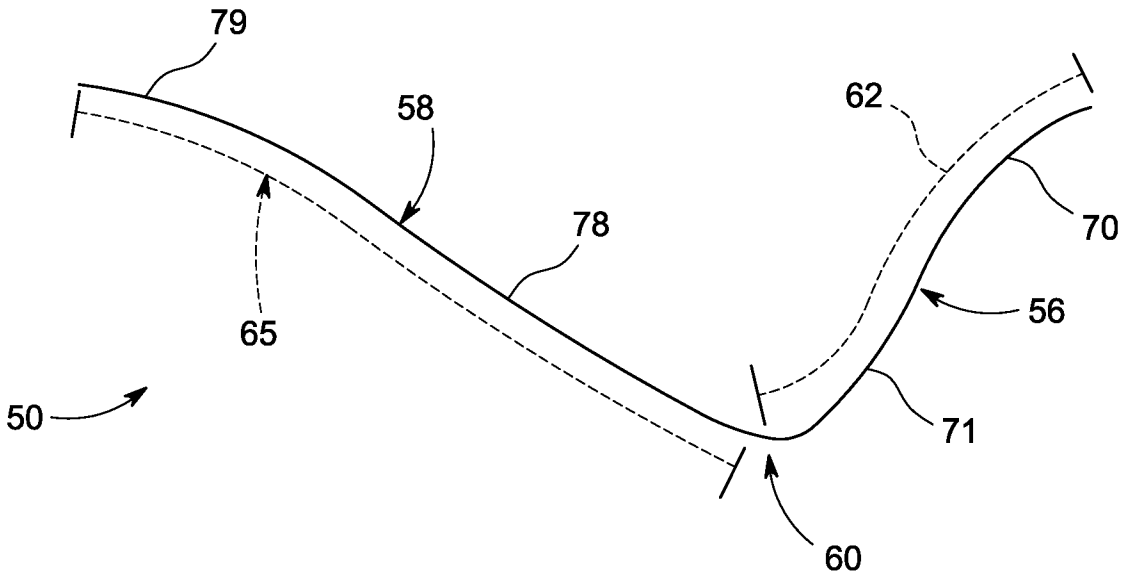
FIG. 4 is a graph illustrating the butterfly plate in accordance with an exemplary embodiment.

With this arrangement, steam passing from IP turbine portion 6 enters into LP turbine inlet 40 and is passed to LP turbine portion 8 via first and second LP turbine sections 21 and 24. The steam passes into LP hood portion 8 through a first diffusing passage (not separately labeled) that extends between first bearing cone 30 and first steam guide 31, and a second diffusing passage (also not separately labeled) that extends between second bearing cone 34 and second steam guide 35. In addition to passing steam into LP hood portion 8, first and second steam guides 31 and 35 deliver steam into interior housing 17 through first and second outlet sections 32 and 36. That is, steam passing from first and second outlet sections 32 and 36 flows over first and second steam guides 31 and 35 into interior housing 17 toward lower opening 18. In the exemplary embodiment shown, first exhaust hood section 20 includes an asymmetric butterfly plate 50 that guides the steam through interior housing 17 toward lower opening 18 with low pressure losses in the steam flow. That is, asymmetric butterfly plate 50 in accordance with the exemplary embodiment described below improves static pressure recovery. Second exhaust hood section 23 includes an asymmetric butterfly plate 55 that is, in accordance with one aspect of the exemplary embodiment, substantially a mirror image of asymmetric butterfly plate 50. Accordingly, reference will now be made to FIG. 4 in describing asymmetric butterfly plate 50 with an understanding that asymmetric butterfly plate 55 is substantially similarly formed.

In accordance with an exemplary embodiment, asymmetric butterfly plate 50 includes a non-symmetrical curvilinear profile having a first section 56 and a second section 58 joined at a vertex 60. The term "vertex" should be understood to mean a point that defines an intersection of first and second sections 56 and 58. First section 56 includes a first length 62 having a first curvilinear profile and second section 58 includes a second length 65 having a second curvilinear profile. First length 62 is distinct from second length 65. More specifically, first length 62 is shorter than second length 65. Vertex 60 is spaced from outlet section 32 of first steam guide 31 by about 5-10% of half of a distance between outlet section 32 and outlet section 36 of second steam guide 35. In accordance with one aspect, vertex 60 is spaced at an angle of about 30° circumferentially from a center plane or symmetric plane of exhaust hood 11.

In further accordance with the exemplary embodiment shown, first section 56 includes first complex curvilinear profile defined by a first segment 70 and a second segment 71. First segment 70 includes a positive curvature and second segment 71 includes a negative curvature. The terms "negative" and "positive" are simply used to describe that first curvilinear segment 70 includes a curvature that is the opposite of the curvature of second curvilinear segment 71. In still further accordance with the exemplary embodiment shown, second section 58 includes a second complex curvilinear profile defined by a first part 78 and a second part 79. First part 78 may include a generally linear curvature or optionally a generally negative curvature, while second part 79 includes a positive curvature.

At this point it should be understood that the spacing between vertex 60 and the outer end (not separately labeled) of first steam guide 31 as well as the overall shape of asymmetric butterfly plate 50 contribute to reducing vortices in the steam flow exiting from LP steam turbine portion towards lower opening 18. Reducing vortices in the steam flow leads to fewer pressure losses and enhanced exhaust hood recovery. In addition, a non-symmetric or asymmetric butterfly plate, mounted in an asymmetric exhaust hood will facilitate distribution of upper half flow according to a flow area of each half. An asymmetric butterfly plate will also allow equal steam to be passed through each half halves of a symmetric plane when last stage exit flow has a high swirl. In an asymmetric side exhaust hood, upper half hood height can be different than the lower half hood height and thus provide different flow areas. In the asymmetric side exhaust hood, the asymmetric butterfly plate turns flow on one side 180° toward a condenser and therefore distributes flow according to the flow area for each half of the non-symmetric side exhaust hood. It should be further understood that the exemplary embodiments provide a mechanism for guiding steam flow from an upper portion in an exhaust hood toward a condenser. The asymmetric butterfly plate is sized and shaped so as to reduce the creation of vortices in the steam flow to avoid efficiency loses in the turbomachine system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An asymmetric butterfly plate for a steam turbine exhaust hood, the butterfly plate comprising:

a non-symmetrical curvilinear profile having a first section that extends to a second section through a vertex, the first section having a first complex curvilinear profile including a first segment having a positive curvature and a second segment having a negative curvature and the second section having a second curvilinear profile that is distinct from the first curvilinear profile, the butterfly plate being configured and disposed to guide a fluid flow from an exhaust hood upper portion toward a condenser, the non-symmetrical curvilinear profile reducing fluid flow vortices to lower turbomachine efficiency loses.

2. The asymmetric butterfly plate according to claim 1, wherein the first section includes a first length and the second section includes a second length, the first length being distinct from the second length.

3. The asymmetric butterfly plate according to claim 1, wherein the first section includes a first length and the second section includes a second length, the second length being greater than the first length.

4. The asymmetric butterfly plate according to claim 1, wherein the second section includes a second complex curvilinear profile.

5. The asymmetric butterfly plate according to claim 4, wherein the second complex curvilinear profile includes a first part having one of a generally linear curvature and a generally negative curvature and a second part having a generally positive curvature.

6. A steam turbine exhaust hood comprising:

an exhaust hood section; and an asymmetric butterfly plate arranged in the exhaust hood section, the asymmetric butterfly plate including a non-symmetrical curvilinear profile having a first section that extends to a second section through a vertex, the first section having a first complex curvilinear profile including a first segment having a positive curvature and a second segment having a negative curvature and the second section having a second curvilinear profile that is distinct from the first curvilinear profile.

7. The steam turbine exhaust hood according to claim 6, wherein the exhaust hood section includes an upper section operatively coupled to a lower section through first and second side sections, one of the first and second side sections including a steam outlet.

8. The steam turbine exhaust hood according to claim 6, wherein the first section includes a first length and the second section includes a second length, the second length being greater than the first length.

9. The steam turbine exhaust hood according to claim 6, wherein the second section includes a second complex curvilinear profile.

10. The steam turbine exhaust hood according to claim 9, wherein the second complex curvilinear profile includes a first part having one of a generally linear curvature and a generally negative curvature and a second part having a generally positive curvature.

11. The steam turbine exhaust hood according to claim 10, wherein the exhaust hood section is non-symmetric.

12. A steam turbomachine system comprising:

a turbine portion including an inlet section and an exhaust section; and an exhaust hood mounted to the exhaust section, the exhaust hood including:

an exhaust hood section; and an asymmetric butterfly plate arranged in the exhaust hood section, the asymmetric butterfly plate including a non-symmetrical curvilinear profile having a first section that extends to a second section through a vertex, the first section having a first complex curvilinear profile including a first segment having a positive curvature and a second segment having a negative curvature and the second section having a second curvilinear profile that is distinct from the first curvilinear profile.

13. The steam turbomachine system according to claim 12, wherein the exhaust hood section includes an upper section operatively coupled to a lower section through first and second side sections, one of the first and second side sections including a steam outlet.

14. The steam turbomachine system according to claim 12, wherein the second section includes a second complex curvilinear profile.

15. The steam turbomachine according claim 14, wherein the second complex curvilinear profile includes a first part having one of a generally linear curvature and a generally negative curvature and a second part having a generally positive curvature.

* * * * *